United States Patent [19]

Canterbury, Sr.

[11] Patent Number: 4,854,066

[45] Date of Patent: Aug. 8, 1989

[54] ADJUSTABLE RIFLE REST

[76] Inventor: Randall L. Canterbury, Sr., R.R. 1, Box 2895, Berryville, Va. 22611

[21] Appl. No.: 284,184

[22] Filed: Dec. 14, 1988

[51] Int. Cl.[4] ..... F41C 29/00

[52] U.S. Cl. ..... 42/94

[58] Field of Search ..... 42/94; 89/37.04

[56] References Cited

U.S. PATENT DOCUMENTS

| | | | |
|---|---|---|---|
| 879,052 | 2/1908 | Jeranek | 42/94 |
| 1,890,423 | 12/1932 | Teagarden | 42/94 |
| 3,156,062 | 11/1964 | Stevenson et al. | 42/94 |
| 3,225,656 | 12/1965 | Flaherty et al. | 42/94 |
| 4,007,554 | 2/1977 | Helmstadter | 42/94 |

*Primary Examiner*—Charles T. Jordan

*Attorney, Agent, or Firm*—Arthur L. Branning

[57] ABSTRACT

An adjustable rifle rest including a cylindrical standard implantable into the ground, a rotatable yoke mounted on the upper end of the standard, a sleeve snugly but rotatably and slidingly engaging the standard, a member having a horizontal portion with one end fixed to the sleeve and the other end terminating in an upwardly extending vertical portion, a fixed yoke mounted on the upper end of the vertical portion of the member, a structure affixed to the lower end of the standard to aid in implanting the standard, and an assembly operable to vary the length of the standard.

8 Claims, 2 Drawing Sheets

ADJUSTABLE RIFLE REST

BACKGROUND OF THE INVENTION

The invention relates to an adjustable rifle rest and more particularly to an adjustable rifle rest particularly adapted for field use.

Rifle rests or gun supports are commonly used to firmly support and hold a rifle in order to avoid unwanted movements of the rifle in use while at the same time permitting the rifleman to freely rotate and pivot the rifle horizontally and vertically in order to sight the rifle in on a target or game. Such rests or supports permit the rifleman to shoot with far greater accuracy than is possible when the rifle is held freely and also permit the rifle to be more accurately sighted-in.

Some prior art rifle rests support the rifle at only one point and thus do not provide sufficient support for the rifle to prevent the unwanted movements thereof mentioned above.

Rifle rests are known that support the rifle at two spaced points in order to provide the desired degree of support, but the latter are characterized by being unduly complex in construction and thus subject to a degree of unreliability, particularly in field use. Some of the prior art two point rifle supports are awkward and cumbersome to use, particularly in the field. In addition such rests because of their complexity are expensive to produce.

SUMMARY OF THE INVENTION

It is therefore an object of the invention to provide a simple, reliable and inexpensive two point rifle support or rest.

It is another object of the invention to provide a rifle rest that functions trouble free and is not susceptible to failure under the rigors of field use.

It is a further object of the invention to provide a rifle rest that is simple and easy to use.

It is yet another object of the invention to provide a rifle rest wherein the attitude of the rifle supported by the rest may be quickly changed to facilitate the tracking of a moving target or game.

Briefly, in order to accomplish the above and other objects and attendant advantages of the invention, which may become apparent upon consideration of the description of a preferred embodiment below when taken with the accompanying drawing, in accordance with the invention there is provided a cylindrical standard implantable into the ground, a freely rotatable front rifle support mounted on the upper end of the standard, a sleeve snugly but rotatably and slidingly engaging the standard, a member having a horizontal portion with one end thereof fixed to the sleeve and the other end terminating in an upwardly extending portion, and a fixed rifle support mounted on the upper end of the vertical portion of the member. Means may be provided to assist in implanting the standard into the ground. In addition, means may be provided to vary the length of the standard to adjust the height of the rest to suit the height of a particular user.

DESCRIPTION OF A PREFERRED EMBODIMENT

Figure 1:
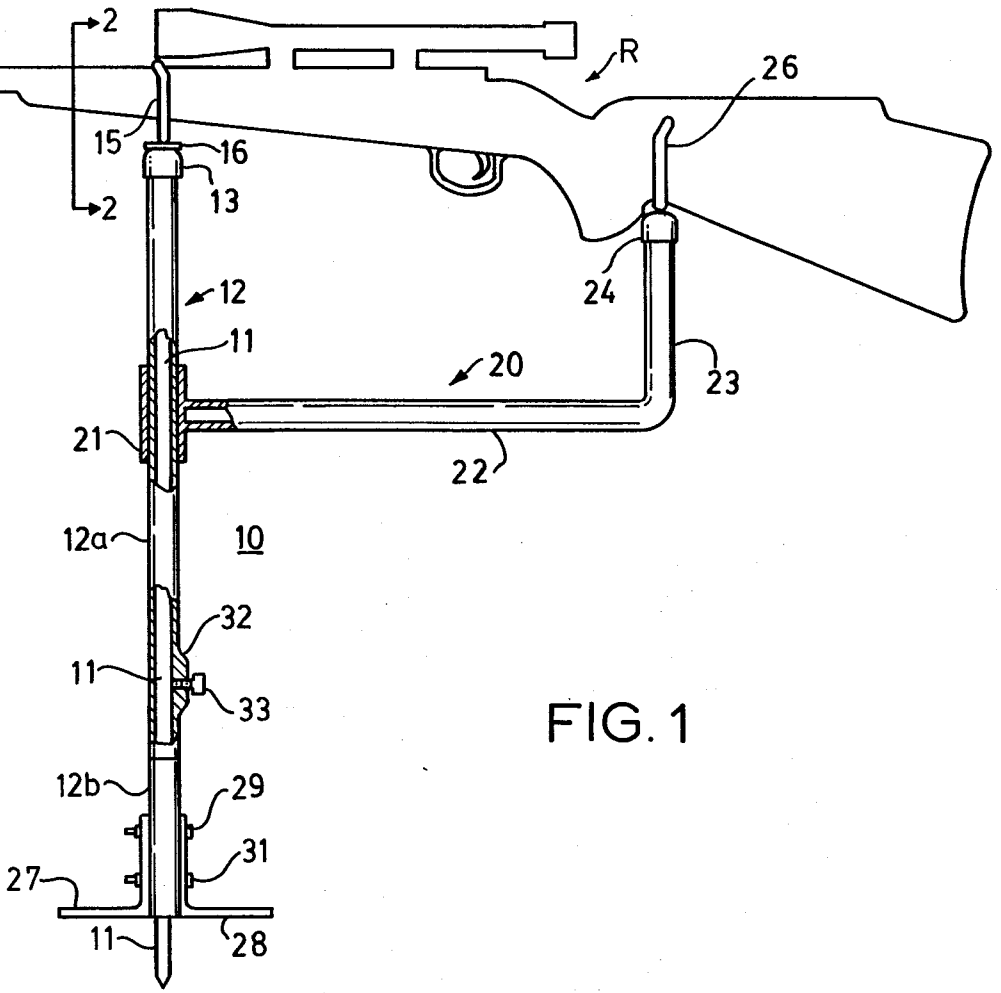
FIG. 1 is a side elevation view, with parts broken away, showing a preferred embodiment of the invention.

Referring to FIG. 1, there is shown a rifle rest 10 for supporting a rifle R. Rifle rest 10 includes a rod 11 pointed at one end whereby the rod may be implanted into the ground. The remainder of rod 11 is telescopically received into a tubular standard 12 having separate upper and lower portions **12*a*, 12*b*** for a purpose to be later disclosed.

Figure 2:
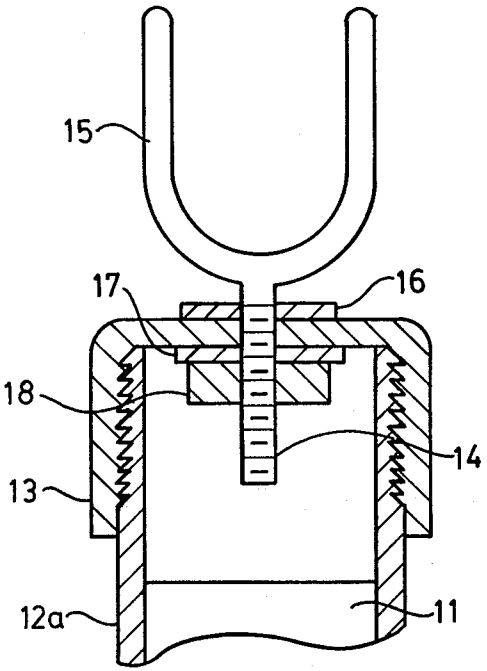
FIG. 2 is an enlarged partial sectional view taken on line 2—2 of FIG. 1 showing the front rifle support structure of the invention in greater detail.

Referring to FIG. 2 (from which rifle R has been omitted for clarity) the upper portion **12*a* of standard 12 is externally threaded to receive an internally threaded cap 13 having an axial bore therein to receive the integral stem 14 of an otherwise generally U-shaped front rifle support yoke 15. A washer 16 may be interposed between the U-shaped portion of yoke 15 and cap 13. Stem 14 may be threaded to receive a washer 17 and a nut 18 in order to retain yoke 15 in cap 13. Nut 18 is loosely fitted on stem 14 in order to permit yoke 15** to freely rotate and may be fixed in place by a cotter pin, or the like.

Referring now again to FIG. 1, there is shown a sleeve 21, snugly but rotatably and slidingly engaging standard 12. A member 20, which may be tubular as shown, has a horizontal portion 22 having one end secured to sleeve 21 as by welding, brazing, or soldering (depending upon the materials used for sleeve 21 and the member 20) and the other end terminating in an upwardly extending vertical portion 23 which may be closed at the upper end thereof by a cap 24. A non-rotating rear rifle support yoke 26, having at least the same external configuration as front rifle support yoke 15, is mounted on cap 24. Portions 22, 23 of member 20 may be integral, as shown, or if tubular, they may comprise separate members joined by an elbow.

Continuing to refer to FIG. 1, standard 12 is provided with a means, such as a pair of angle brackets 27, 28, which may be stood upon to drive rod 11 into the ground and which also functions to further stabilize standard 12 against movement by providing a bearing surface against the ground. Brackets 27, 28 and rod 11 may be secured to portion **12*b* of standard 12 as by bolts 29, 31**, to form a unitary structure.

Upper portion **12*a* of standard 12 may be provided with a boss 32, or the like, having a threaded bore therein to receive an Allen-head screw 33, or the like. The length of standard 12 may thereby be adjusted to suit the height of the rifleman by loosening screw 33, raising standard portion 12*a* along rod 11 until the desired length of standard 12 is achieved and then retightening screw 33 to secure tubular portion 12*a* in the selected position on rod 11**.

Figure 3:
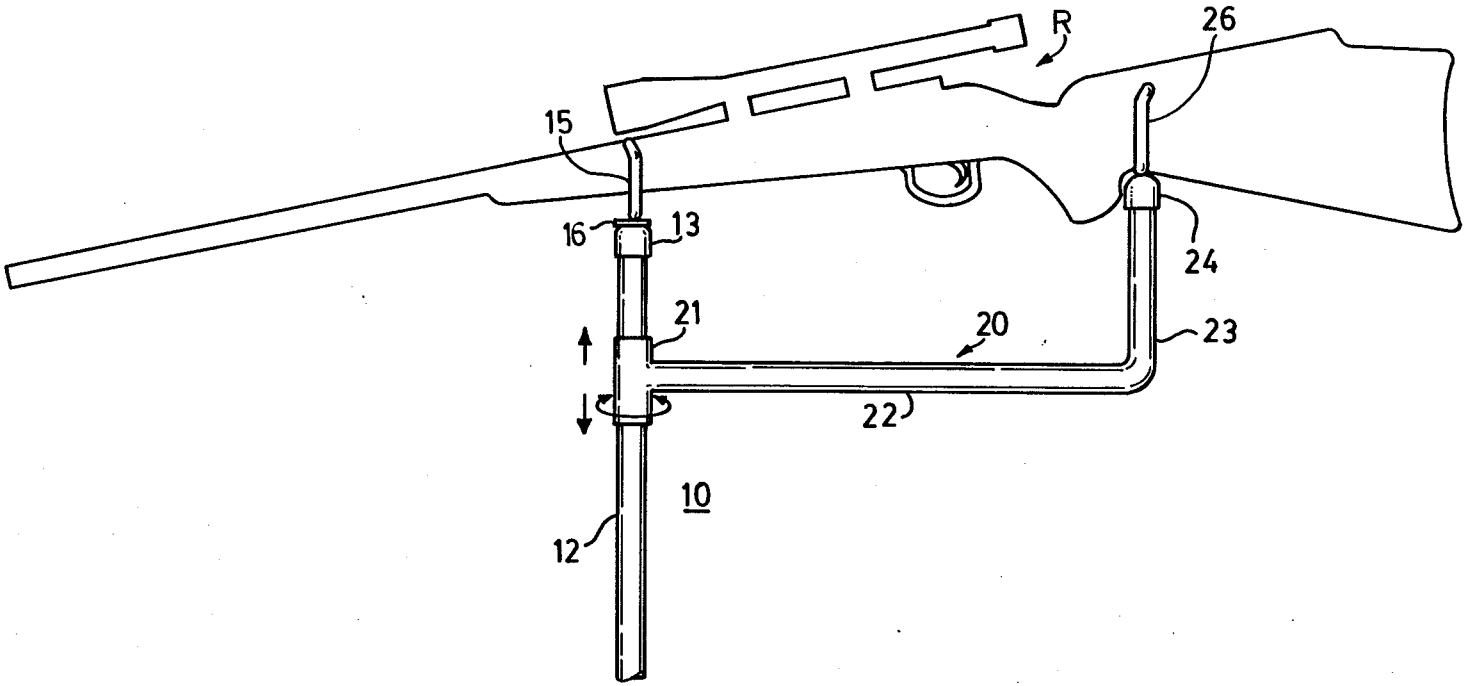
FIG. 3 is a view illustrating the mode of operation of the invention.

Referring to FIG. 3, rod 11 is implanted into the ground, standard 12 is adjusted to the desired height, and rifle R is placed in front and rear rifle support yokes 15, 26, as shown. The rifleman (not shown) grasps sleeve 21 with one hand and the grip of the rifle stock with the other hand, in the usual manner, with a finger of that hand engaging the trigger of the rifle.

The weight of the rifle bearing down on yoke 26 jams sleeve 21 on standard 12 to prevent vertical movement thereof while at the same time sleeve 11 remains free to rotate about standard 12, thus permitting rifle R to be rotated in a horizontal plane. A slight upward movement of the hand holding the rifle relieves the pressure on sleeve 21 permitting the sleeve to be freely slid up or down standard 12, causing the rifle to pivot in a vertical plane about front yoke 15. If the sleeve is slid up standard 12, as shown in FIG. 3, the rifle is pivoted down while, conversely, if sleeve 21 is slid down standard 12, the the rifle is pointed up. Thus the rotating, sliding motion of sleeve 21 permits the rifle to be quickly and easily rotated and pivoted in order to sight and hold the rifle on a stationary target or sight on and track a moving target or game. In addition, as mentioned above, rifle rest 10 provides a stable support permitting a rifle to be easily sighted-in, if desired, by shooting test rounds and adjusting the sight or sights as necessary.

In order to facilitate storage and transport of the rifle rest, cap 13, which may be put on only hand tight, may be temporarily removed permitting sleeve 21 and the remainder of the rear rifle support structure to be removed from standard 12, breaking the rifle rest down into two major components. Thereafter cap 13 is replaced on standard 12 to prevent loss.

Having thus described a preferred embodiment of the invention, what is claimed is:

1. An adjustable rifle rest comprising: a cylindrical standard implantable into the ground; a rotatable front rifle support mounted on the upper end of said standard; a sleeve snugly but rotatably and slidingly engaging said standard; a member having a horizontal portion with one end thereof fixed to said sleeve and the other end terminating in an upwardly extending vertical portion; and a rear rifle support fixedly mounted on the upper end of the vertical portion of said member.

2. The adjustable rifle rest of claim 1 wherein: means are provided adjacent the lower end of said standard to aid in implanting said standard.

3. The adjustable rifle rest of claim 2 wherein: means are provided to vary the length of said standard.

4. The adjustable rifle rest of claim 3 wherein: the front rifle support is removably mounted whereby the support may be removed and later replaced permitting said sleeve to be slid off of said standard thereby separating said rifle rest into two major components for ease of storage and transport.

5. The rifle rest of claim 4 wherein said standard is tubular and wherein there is further provided: a rod having a pointed end for implantation into the ground with the remainder of the rod being telescopically received into said standard; means having at least a horizontal portion, and means fixedly securing said at last mentioned means, the lower portion of said standard, and the adjacent telescopically received portion of said rod together to form a unitary structure.

6. The rifle rest of claim 5 wherein said standard is divided into separate upper and lower portions whereby the upper portion of said standard may be slid along said rod to vary the length of said standard and wherein there is further provided: means to secure the upper portion of said standard in a selected position on said rod.

7. The rifle rest of claim 6 wherein said front rifle support comprises a U-shaped yoke having an integral stem portion; a cap removably secured to the upper end of said standard and having an axial bore therein to receive said stem; and means to rotatably secure said stem in said cap.

8. The rifle rest of claim 7 wherein said rear rifle support comprises a yoke having at least the same external configuration as said front rifle support yoke.

* * * * *